United States Patent [19]

Acharya et al.

[11] Patent Number: 4,856,285

[45] Date of Patent: Aug. 15, 1989

[54] CRYO-MECHANICAL COMBINATION FREEZER

[75] Inventors: Arun Acharya, East Amherst; Michael A. Marchese, Elmsford; Jeffert J. Nowobilski, Orchard Park, all of N.Y.

[73] Assignee: Union Carbide Corporation, Danbury, Conn.

[21] Appl. No.: 246,862

[22] Filed: Sep. 20, 1988

[51] Int. Cl.[4] ..... F25D 13/06

[52] U.S. Cl. ..... 62/63; 62/332; 62/374; 62/380; 62/434

[58] Field of Search ..... 62/63, 266, 232, 374, 62/375, 380, 434

[56] References Cited

U.S. PATENT DOCUMENTS

| | | | |
|---|---|---|---|
| 3,156,101 | 11/1964 | McGuffey | 62/434 |
| 3,298,188 | 1/1967 | Webster et al. | 62/63 |
| 3,376,710 | 4/1968 | Hirtensteiner | 62/374 |
| 3,507,128 | 4/1970 | Murphy et al. | 62/63 |
| 3,512,370 | 5/1970 | Murphy et al. | 62/64 |
| 3,531,946 | 10/1970 | Hart | 62/332 |
| 3,805,538 | 4/1974 | Fritch, Jr. et al. | 62/63 |
| 4,237,695 | 12/1980 | Oberpriller et al. | 62/332 |

OTHER PUBLICATIONS

Koach Engineering and Manufacturing, Inc. undated sales brochure entitled: "Innovation and Efficiency in Food Freezing Equipment," (No date given).

*Primary Examiner*—Ronald O. Capossela

*Attorney, Agent, or Firm*—Shirley L. Church; Stanley Ktorides

[57] ABSTRACT

This invention pertains to a method and apparatus for cooling and freezing of organic-comprised articles which makes use of liquid cryogen and of chilled gases from a mechanical refrigeration system to provide an economical process for reducing the temperature of the article. The article is contacted with a liquid cryogen and subsequently contacted with circulating cold gases in the mechanical refrigeration system. The improvement relates to the method and apparatus for producing the cold gases which are used in the mechanical refrigeration system; the method comprises using the cryogen vapors generated upon contact of the articles with the liquid cryogen as an indirect heat exchange fluid for removing heat from heat exchange fluids used in the mechanical refrigeration system. This indirect heat transfer using cryogen vapors supplements cooling of the mechanical refrigeration system cold gases by the mechanical refrigeration system chiller.

25 Claims, 5 Drawing Sheets

CRYO-MECHANICAL COMBINATION FREEZER

BACKGROUND OF THE INVENTION

1. Field of the Invention

This invention pertains to a method of cooling and freezing organic-comprised articles which makes use of liquid cryogen and cold gases to provide an economical process for reducing the temperature of the article. The invention also pertains to the freezing system used to practice the method, which system comprises a combination of cryogenic freezer elements with mechanical freezer elements to provide cost savings efficiencies in terms of combined capital expenditures and operating expenses.

2. Background Art

The freezing of foodstuffs and biologicals requires careful consideration of the physical changes which occur in the material when it is frozen. Many biological or foodstuff materials must be frozen very rapidly to prevent the growth of damaging crystal formations which can break the cell structure of the material, resulting in destruction of the biological activity or food structure and taste characteristics. In addition, rapid production of a crust on the surface of the article being cooled or frozen prevents the transmission of fluids from the interior of the article to the surface of the article from which such fluids can be evaporated or carried off by the process environment. By maintaining the frozen crust over substantially the entire article surface while the article is brought to the desired frozen temperature throughout, loss of fluids from the interior of the article can be prevented or at least greatly reduced. Rapid freezing or frozen crust formation is frequently obtained by direct immersion of the articles to be frozen in a cryogenic liquid. However, typically the cryogenic media is too expensive to completely freeze an article solely by immersion.

In addition, as disclosed in U.S. Patent Application, Ser. No. 219,666, pending assigned to the assignee of the present invention, which application is hereby incorporated by reference, there is an advantage in limiting the depth of crust freezing which takes place upon exposure of the article to a liquid cryogen, so that thermal cracking of the article being frozen is reduced or prevented. By controlling the depth or thickness of frozen crust and the surface temperature of the article, and by maintaining control of the temperature profile of the article while bringing the article to the desired temperature throughout, a higher quality frozen article is produced.

Use of a liquid cryogen to crust freeze an article provides the advantages described above. The additional cooling necessary to bring the article to the desired frozen temperature throughout can be provided using cryogen vapor heat exchange with the article, as described in the above-referenced patent application. However, the cost of the cryogenic media used to provide the total heat removal necessary can be prohibitive for highly price competitive consumer articles such as foodstuffs. In cases where competitive price is critical, mechanical refrigeration can be used to achieve a portion of the cooling after crust freezing of the article.

A typical mechanical refrigeration system for cooling or freezing articles comprises a cooling chamber in which the article to be cooled is directly contacted with chilled gases which draw heat from the article into the chilled gases. Typically the chilled gases are recycled within the cooling chamber to take full advantage of their heat removal capability, although a portion of the chilled gases can be discarded after contact with the article to be cooled and replaced with new chilled gas makeup if desired. The heat transferred to the chilled gases must continually be removed during their recirculation, and the means of heat removal is commonly a vapor compression refrigerator or "chiller." The chiller typically comprises an evaporator, compressor, condenser, and expansion valve in that sequence. The chiller generally comprises a closed loop with a refrigerant recycled therein. At the evaporator, the refrigerant is changed from a liquid to a saturated vapor by indirect contact through a heat exchange surface with the gases to be cooled (chilled), whereby the heat content of the gases is reduced. Typical refrigerants used in the chiller include ammonia, chloro-fluorocarbons, and other FDA approved refrigerants. When refrigerants of the kinds listed above are used in typical chillers, the chilled gas temperatures generated in a typical mechanical freezer system refrigeration range from about −60° F. (−51° C.) to about 0° F. (−18° C.).

The heat transfer rates typically available from a mechanical refrigeration system are not sufficiently high to provide the desired crust freezing of an article as previously described. In addition, the cost of mechanical refrigeration equipment is high, requiring a substantial initial capital investment. Despite these disadvantages, mechanical refrigeration systems provide operational efficiency, in terms of heat content removed from the recirculated chilled gases per horsepower or kilowatt cost.

There is, then, an advantage in combining the use of cryogenic and mechanical freezing techniques to provide a high quality product at an economical cost for those applications wherein volume of articles to be processed justifies the initial capital equipment investment in the mechanical system.

An undated sales brochure, entitled: "Innovation and Efficiency in Food Freezing Equipment" by Koach Engineering and Manufacturing Inc., Sun Valley, California describes commercially available cryogenic and mechanical freezing units and recommends use of a combination of these units. The description points out that the combination is attractive due to utilization of the best features of each unit. The brochure diagram shows side-by-side immersion and mechanical units with direct flow of cold nitrogen vapor to the mechanical unit. U.S. Pat. No. 3,298,133, dated Jan. 14, 1967, to R. C. Webster et al describes a method and apparatus for cryogenic freezing of food products, using liquid nitrogen and vapors thereof. The articles travel up an incline to an area where they are sprayed with liquid nitrogen; nitrogen vapors produced in the spray area are directed down the incline to precool the articles. Use of nitrogen vapors created upon contact of liquid nitrogen with the food product to provide additional cooling of the food product provides a more economical freezing system.

U.S. Pat. No. 3,376,710, dated Apr. 9, 1968, to W. E. Hirtensteiner describes an additional cryogenic food freezing apparatus which utilizes both liquid cryogen and cryogen vapors in freezing the food.

U.S. Pat. No. 3,507,128, dated Apr. 21, 1970, to T. H. Murphy, describes a continuous method and apparatus for freezing products using a combination of mechanical and liquid gas freezing techniques. Mechanical refrigeration is used to precool the product substantially to its freezing point, followed by spray application of liquid gas to substantially freeze the product, followed by mechanical refrigeration to bring the product to its desired final temperature throughout.

U.S. Pat. No. 3,512,370, dated May 19, 1970, to T. H. Murphy describes a batch method and apparatus for freezing products which is very similar to the continuous process described in U.S. Pat. No. 3,507,128.

U.S. Pat. No. 3,805,538, dates Apr. 23, 1974, to C. F. Fritch, Jr., et al.; discloses a process for freezing individual food segments which comprises contacting the segments with a spray of liquid cryogen, followed by a refrigerated gas blast and then a second spray of liquid cryogen. The refrigerated gas comprises cryogen vapor which is cooled using a refrigeration coil which is cooled by a mechanically driven compressor, an absorption system or the like. The refrigeration coil is maintained free of ice by spraying a solution of antifreeze over the surface of the coils.

The present invention provides for crust freezing of the article to be processed, followed by mechanical means cooling of the article to the desired final temperature. The present invention provides an improvement in the utilization of cryogen vapors within the process in a manner which better takes advantage of the heat removal capabilities of such vapors.

SUMMARY OF THE INVENTION

The method of the present invention comprises the steps of contacting an article to be reduced in temperature directly with a liquid cryogen and subsequently contacting the article with cold gases in a mechanical refrigeration system to further cool the article, wherein the improvement comprises:

using cryogen vapor generated by the direct contact of the article with the liquid cryogen to cool the cold gases used in the mechanical refrigeration system. The cryogen vapor is used for indirect heat exchange with recirculating cold gases; or indirect heat exchange with refrigerant from the chiller comprising the mechanical refrigeration system; or indirect heat exchange with an intermediary refrigerant used to chill the cold gases or the chiller refrigerant; or combinations thereof.

Use of cryogen vapor to supplement mechanical refrigeration cooling can be further expanded by directly adding cryogen vapor to the mechanical refrigeration system cold gas/article contacting area, in addition to the indirect heat exchange disclosed above. However, addition of cryogen vapor into the recirculating cold gases in the mechanical refrigeration system can create an atmosphere which will not support breathing of workers in the area, requiring a change in operating procedures and limiting system access by workers. In addition, cryogen vapor, which may be at temperatures as low as −320° F. (−196° C.) must be handled with care to avoid potential harm to elements of the mechanical refrigeration system.

Use of an intermediary heat transfer fluid (refrigerant) between the cryogen vapor and the chiller refrigerant or cold gases above, is preferred when the temperature of the cryogen vapor is sufficiently low that the mechanical refrigeration means would be damaged by exposure to cold gases cooled using the cryogen vapor or when the refrigerant used in the chiller would tend to freeze or plate out on heat transfer surfaces at the temperature of the cryogen vapor, to the substantial detriment of the mechanical refrigeration means.

The liquid cryogen can be contacted with the article to be cooled by immersing the article in liquid cryogen, spraying the surface of the article with liquid cryogen, or combinations thereof.

The freezing system of the present invention is a combination cryogenic mechanical freezer, comprising a means for contacting an article to be reduced in temperature with a liquid cryogen and a mechanical refrigeration system means for further cooling the article, wherein the further cooling means comprises both means for transferring heat from the article to cold gases circulating in the mechanical refrigeration system, and means for producing the cold gases, wherein the improvement comprises:

using a means for producing the cold gases which includes a chiller or equivalent mechanical refrigeration device, and wherein cryogen vapor produced in the liquid cryogen contacting means is used, via indirect heat transfer, in combination with the mechanical refrigeration system chiller to produce the cold gases. The means by which the cryogen vapor is used in combination with the chiller to produce cold gases is selected from one of the following four means or from combinations thereof.

One preferred embodiment of the present invention is shown at FIG. 3 and includes an indirect heat transfer means which comprises a heat transfer surface on heat transfer loop 50 having cryogen vapor on one side and chiller refrigerant on the other side, whereby the heat content of the chiller refrigerant is reduced, and a heat transfer surface 58 which is in communication with the chiller refrigerant from heat transfer loop 50, heat transfer surface 58 having chiller refrigerant on one side and cold gases on the other side, whereby the heat content of the cold gases is reduced.

A second preferred embodiment of the present invention is shown at FIG. 4 and includes means of using cryogen vapor to produce cold gases in an indirect heat transfer means comprising a heat transfer surface on heat transfer loop 84 having cryogen vapor on one side and a refrigerant fluid on the other side, whereby the heat content of the refrigerant fluid is reduced, wherein the refrigerant fluid from heat transfer loop 84 is in communication with a heat transfer surface 88 having the refrigerant fluid on one side and mechanical refrigeration system cold gases on the other side of heat transfer surface 88, and wherein heat is removed from the cold gases using heat transfer surface 88 in addition to another heat transfer surface 94 having chiller refrigerant on one side and cold gases on the other side.

As shown in FIG. 6, it is possible to combine the means of producing cold gases which are described in the two preferred embodiments above to take best advantage of the cooling capacity of the cryogen vapors in some applications. The cryogen vapors can be used to cool two different refrigerant loops in series, with the first refrigerant loop comprising the refrigerant fluid cooled at heat exchange surface 84 and the second refrigerant loop comprising the chiller refrigerant cooled at the heat transfer surface on heat transfer loop 50' at heat exchange surface 88. Thus, the cryogen vapors are first used to cool a refrigerant fluid which is used to remove heat from circulating cold gases in the mechanical refrigeration means, and residual cooling capacity in the cryogen vapors is subsequently used to subcool chiller refrigerant which is also used to remove heat from circulating cold gases in the mechanical refrigeration means at heat exchange surface 88.

A third, less preferred means by which cryogen vapor is used to produce the cold gases comprises an indirect heat transfer means comprising a first heat transfer surface having cryogen vapor on one side and an intermediary refrigerant fluid on the other side, whereby the heat content of the intermediary fluid is reduced, wherein the intermediary fluid from this first heat transfer surface is in communication with a second heat transfer surface having intermediary fluid on one side and the chiller refrigerant on the other side, whereby the heat content of the chiller refrigerant is reduced, and wherein the chiller refrigerant from this second heat transfer surface is in communication with a third heat transfer surface having chiller refrigerant on one side and cold gases on the other side, whereby the heat content of the cold gases is reduced.

FIG. 5 shows a fourth, less preferred embodiment for using cryogen vapors to produce cold gases. This embodiment comprises a heat transfer surface 130 having cryogen vapor on one side and a first refrigerant fluid on the other side, whereby the heat content of the first refrigerant fluid is reduced, wherein the first refrigerant fluid from heat transfer surface 130 is in communication with a heat transfer surface 134 having the first refrigerant fluid on one side and a second refrigerant fluid on the other side of heat transfer surface 134, whereby the temperature of the second refrigerant fluid is reduced, and wherein the second refrigerant fluid from heat transfer surface 134 is in communication with a heat transfer surface 140 having the second refrigerant fluid on one side and the cold gases on the other side, whereby the temperature of the cold gases is reduced, and wherein the heat removed from the cold gases using heat transfer surface 140 is in addition to a heat transfer surface 142 having chiller refrigerant on one side and cold gases on the other side of heat transfer surface 142. Combinations of the above four means of using cryogen vapors as an indirect heat transfer medium to remove heat from circulating cold gases in the mechanical refrigeration system can also be used.

It will be apparent to one skilled in the art that direct mixing of cryogen vapors, such as liquid nitrogen vapors, with colds gases in the mechanical refrigeration system results in an increase in the concentration of cryogen vapors therein. In an ambient wherein the concentration of cryogen vapors increases, oxygen concentration can decrease to a level which will not support breathing. Thus, one of the advantages of using indirect heat transfer with cryogen vapors is that cryogen vapor does not dilute the cold gases ambient in the mechanical refrigeration system. It is possible to directly mix cryogen vapors with the cold gases when proper precautions are taken to insure the safety of those operating the system, but this is a less preferred cooling technique.

DEFINITIONS

Liquid cryogen, as used in the specification and claims herein, means a liquid refrigerant having a normal boiling point below about 0° F. (−18° C.). Examples of liquid cryogens include liquid nitrogen, liquid air, liquid nitrous oxide, liquid carbon dioxide, and liquid chlorofluorocarbons.

Cryogen vapor, as used in the specification and claims herein, means the fluid formed when the cryogen liquid is evaporated by heat addition.

Cold gases, as used in the specification and claims herein means the gases circulated through the cryo-mechanical refrigeration system which are used to remove heat from the article being cooled or frozen.

Chiller, as used in the specification and claims herein, means the mechanical refrigeration means used to reduce the heat content of gases which comprise at least a portion of the cold gases which are used in contact with articles being cooled or frozen within the cryo-mechanical combination refrigeration system. The chiller can comprise any commonly used mechanical refrigeration means wherein a refrigerant is recovered and recirculated, such as a vapor-compression machine or an absorption system.

Indirect heat transfer, as used in the specification and claims herein means heat exchange without direct contact of the fluids between which the heat is being exchanged.

Direct heat transfer, as used in the specification and claims herein means heat exchange by direct contact of the material between which the heat is being exchanged.

Liquid cryogen immersion means, as used in the specification and claims herein, refers to any means by which an article can be directly submerged in the liquid cryogen spray.

Organic-comprised article, as used in the specification and claims herein means an article comprised of compounds of carbon, and illustratively biological materials such as medical compositions and drugs, and foodstuffs such as fruits, vegetables, meats, fish, poultry, and processed food products.

DETAILED DESCRIPTION OF THE PREFERRED EMBODIMENTS

Figure 1:
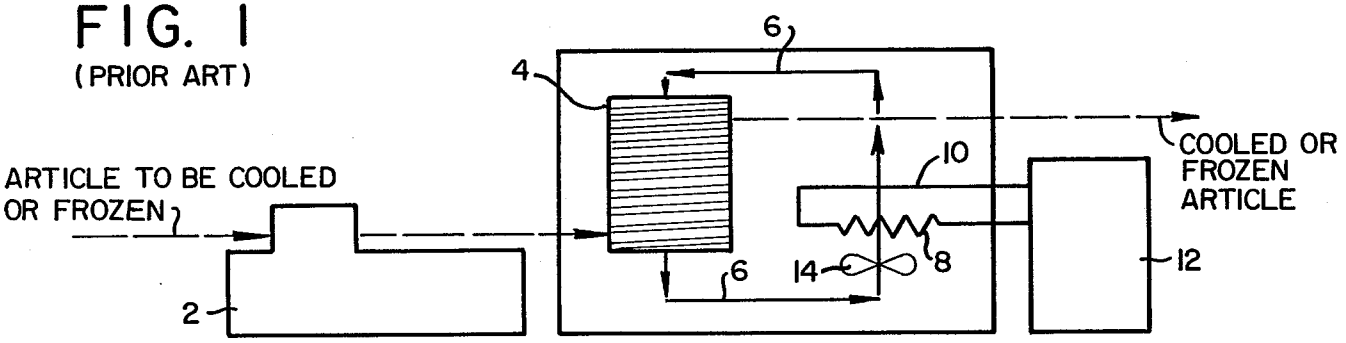
FIG. 1 (PRIOR ART)
FIG. 1 is a schematic showing a mechanical freezing system typical of those presently used in the art for freezing foodstuffs.

A schematic showing a mechanical freezer of a type commonly used in the art is shown in FIG. 1. The article to be cooled or frozen is placed in a loader 2 which feeds the article into a cooling or freezing chamber 4. Inside freezing chamber 4 the article is contacted with chilled gases 6 which are recirculated within the mechanical refrigeration system. The heat content of chilled gases 6 is reduced by passing the gases across a heat exchange surface 8 which contains refrigerant which is circulated through recycle loop 10. Heat is removed from the refrigerant in recycle loop 10 by a chiller 12. The chilled gases 6 are recirculated through chamber 4 using a blower or fans 14.

Figure 2:
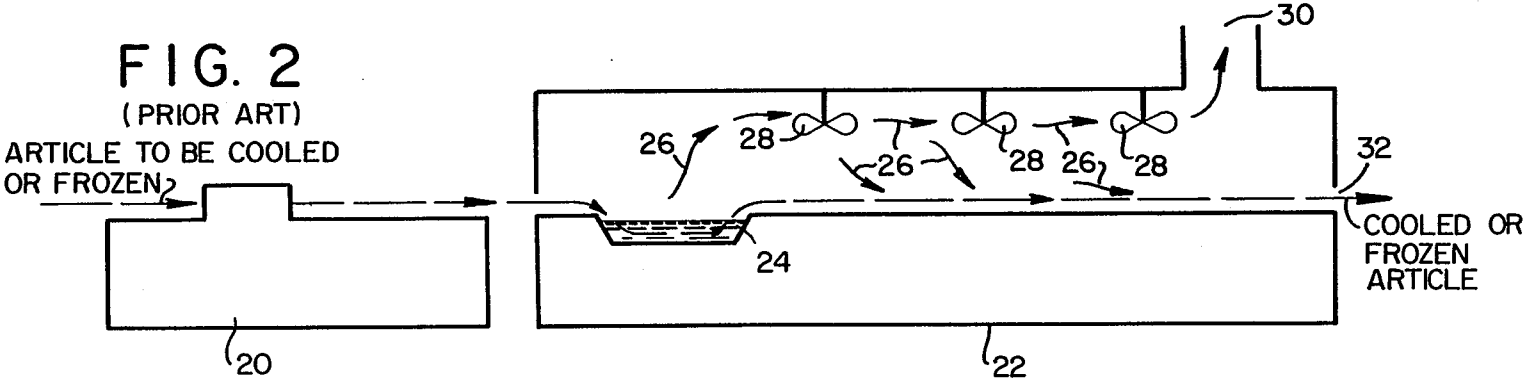
FIG. 2 (PRIOR ART)
FIG. 2 is a schematic showing a cryogenic freezing system of a type currently used for immersion freezing of foodstuffs.

A schematic showing a cryogenic freezer of a type commonly used in the art is shown in FIG. 2. The article to be cooled or frozen is placed in a loader 20 which feeds the article into a tunnel enclosure 22. Inside tunnel 22, the article is immersed in a bath of liquid cryogen 24 (or sprayed with liquid cryogen) to provide at least a frozen crust on the surface of the article. Subsequently the article is contacted with cryogen vapors 26, at least a portion of which are generated by boiling of the liquid cryogen 24 on contact with the article to be cooled or frozen. The cryogen vapors 26 are moved or circulated within tunnel 22 using fans 28 and are withdrawn from tunnel 22 using exhaust duct 30. The article progresses down the tunnel 22 to exit 32, at which time the article has reached the desired temperature throughout.

Figure 3:
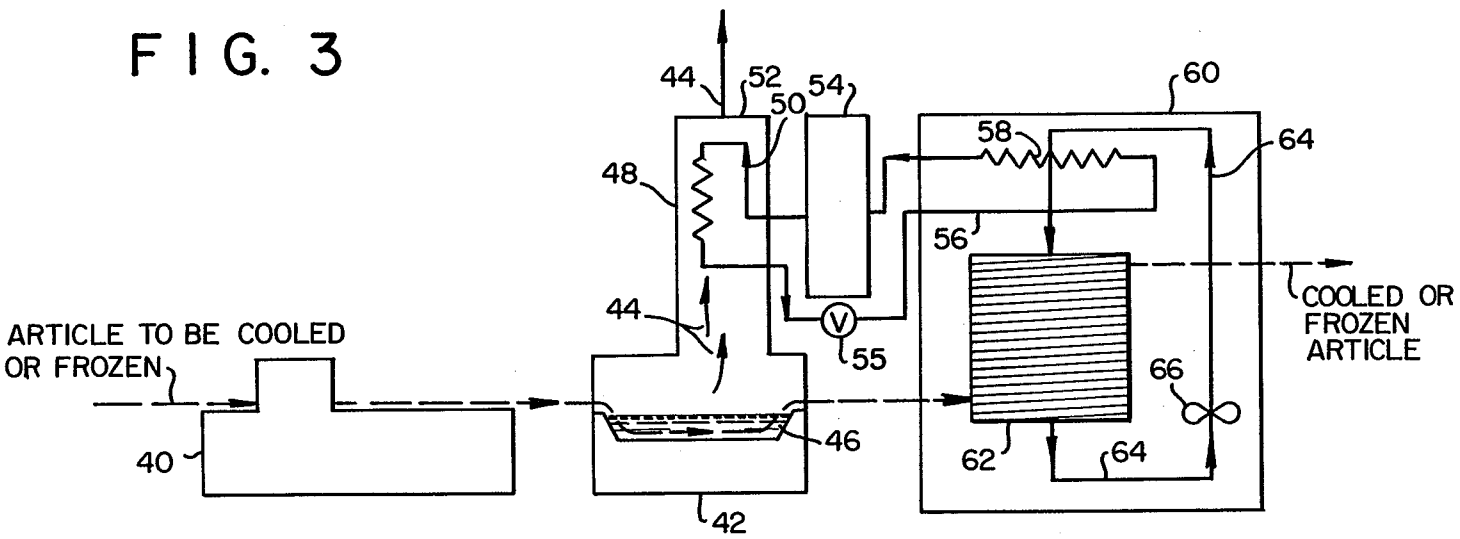
FIG. 3 is a schematic showing a preferred embodiment cryo-mechanical combination freezer wherein the cryogen vapors are used to remove heat content from refrigerant circulated in the mechanical refrigeration system chiller. The cryogen vapors can be used to cool the chiller refrigerant or can be used to cool an intermediary heat transfer fluid which is used to cool the chiller refrigerant, (not shown).

A preferred embodiment of the improved cryomechanical freezer system is shown in FIG. 3. The article to be frozen is placed in a loader 40 which feeds the article to a liquid cryogen contacting area 42. The liquid cryogen contacting means can be an immersion means as shown in FIG. 3 or can be a spray means, or a combination thereof. Cryogen vapor 44 generated by boiling of liquid cryogen in immersion bath 46 is passed through conduit 48 where it is used as the heat transfer medium to remove heat from a refrigerant fluid in heat exchange loop 50/56. Cryogen vapors 44 exit conduit 48 through exit duct 52.

The refrigerant in heat exchange loop section 50 leaving chiller 54 is preferably the same refrigerant as that traveling through heat exchange loop section 56 which supplies refrigerant to heat exchange surface 58. Thus, cryogen vapors 44 are used to subcool the refrigerant which has been condensed by chiller 54 before the refrigerant is passed through expansion valve 55 and on to heat exchange surface 58. It is also possible to use one refrigerant in heat exchange loop section 50 and a different refrigerant in heat exchange loop section 56 with a heat transfer means between the two heat exchange sections (not shown). The use of different refrigerants in heat exchange loop sections 50 and 56 makes it possible to provide mechanical refrigeration means 60 with more flexibility in operational temperature range. However, a portion of the heat content removal capacity of cryogen vapors 44 is lost due to heat transfer inefficiencies when two different refrigerants and heat exchange loops are used with a heat exchange surface between the two loops. In addition, equipment costs increase. The greatest heat content removal capability of cryogen vapors 44 is utilized when heat exchange loop 50 and heat exchange loop 56 are in direct communication with one refrigerant flowing therebetween, and the cryogen vapors 44 are used to subcool refrigerant which has been precooled/condensed by chiller 54. Typically about 60 percent to about 80 percent of the heat content removal from the refrigerant used to chill the cold gases at heat exchange surface 58 is provided by chiller 54, with the other 40 percent to 20 percent, respectively, being provided by heat exchange with cryogen vapors 44.

The article to be cooled or frozen passes from cryogen contacting area 42 into a mechanical refrigeration chamber 62 in which the article is contacted with cold gases 64 which are circulated through chamber 62. The cold gases 64 are reduced in heat content by indirect heat exchange at heat exchange surface 58. A blower system or fan 66 is used to direct recirculating cold gases 64 past heat exchange surface 58.

The preferred embodiment shown in FIG. 3 provides the ability to crust freeze the article in cryogen contacting area 42, ensuring that fluids within the article tend to remain within the article through the freezing process. Heat exchange loop 50 provides a means of using the cooling capability remaining in cryogen vapors 44 to remove heat content from the articles being frozen without exposing the downstream equipment such as freezing chamber 62, heat exchange surface 58, and blower system 66 to the low temperature of cryogen vapor 44.

Although the location of heat transfer surfaces within either the cryogenic portion 42 or the mechanical refrigeration portion 60 of the FIG. 3 cooling/freezing system is intended to be limiting, the position of the heat transfer surfaces relative to other elements in each portion of the system is not intended to be limiting. For example, heat exchange surface 58 within mechanical refrigeration means 60 could be positioned midway up the height of mechanical refrigeration chamber 62 to provide for cross flow ducting of cold gases 64 within the chamber 62.

The thickness of the crust frozen on the surface of the article typically ranges from about 5% to about 20% of the cross-sectional thickness of the article. For example, if the article were a sphere having a cross-sectional diameter, the thickness of the frozen crust at any point around the circumference of the sphere would range from about 5% to about 20% of the cross-sectional diameter. The crust thickness must be controlled so that the crust does not become so thick that thermal cracking of the article occurs due to rapid overcooling of the article or that exterior surfaces of the article become brittle and subject to damage during handling. At the same time, the crust should not be so thin that remelting of the crust occurs before the entire article is brought to the desired temperature. Remelting of the crust can result in loss of fluids from the interior of the article.

Crust thickness is also directly dependent on process economics. As previously discussed, complete freezing of the article by contact with liquid cryogen or contact with liquid cryogen and cryogen vapors only is often too expensive with regard to highly price competitive frozen articles.

The time required to achieve crust freezing to the desired depth will depend on the type of product and its initial temperature. Some examples for foodstuffs follow: a ground beef patty about 0.375 inches (0.95 cm) thick and about 5.0 inches (12.7 cm) in diameter at a temperature of about 40° F. entering a liquid nitrogen immersion bath, will form a crust about 0.05 inches (0.13 cm) thick on its surface in about 7 seconds. A sliced zucchini about 1.0 inches (2.5 cm) in diameter and about 0.2 inches (0.51 cm) thick at a temperature of about 70° F. entering a liquid nitrogen immersion bath, will form a crust about 0.015 inches (0.04 cm) thick on its surface in about 10 seconds. Given an overall cooling and freezing system design, having particular handling equipment and mechanical refrigeration means, one skilled in the art can, with minimal experimentation, determine the desired amount of contact time with the liquid cryogen which will protect surface integrity of the article, and prevent fluid loss and thermal fracture of the article, while providing economical operation in terms of article heat content removal distribution between the cryogenic portion of the freezer and the mechanical refrigeration portion of the freezer.

Cryogen vapors generated by immersion of the article in bath 46 can be used to precool the article prior to immersion in bath 46 and/or to postcool the article subsequent to immersion in bath 46 but prior to entry of the article into the mechanical refrigeration portion of the freezer. This precooling or postcooling of the article is not shown in FIG. 3.

An additional means of further reducing the temperature of the cold gases used in the mechanical refrigeration portion of the freezer is to inject a portion of cryogen vapor 44 directly into cold gas stream 64. This alternative embodiment of the present invention is not shown in FIG. 3. Injection of cryogen vapor into the cold gas stream must be carefully handled to avoid damaging parts of the freezer not designed for exposure to the low temperature of cryogen vapors (−320° F. in the case of vaporized liquid nitrogen). Also, freezer safety is a factor since the cold gases used for recirculation might typically be air and an increase in nitrogen content can reduce the oxygen concentration of the air to a level which is not breathable.

Figure 4:
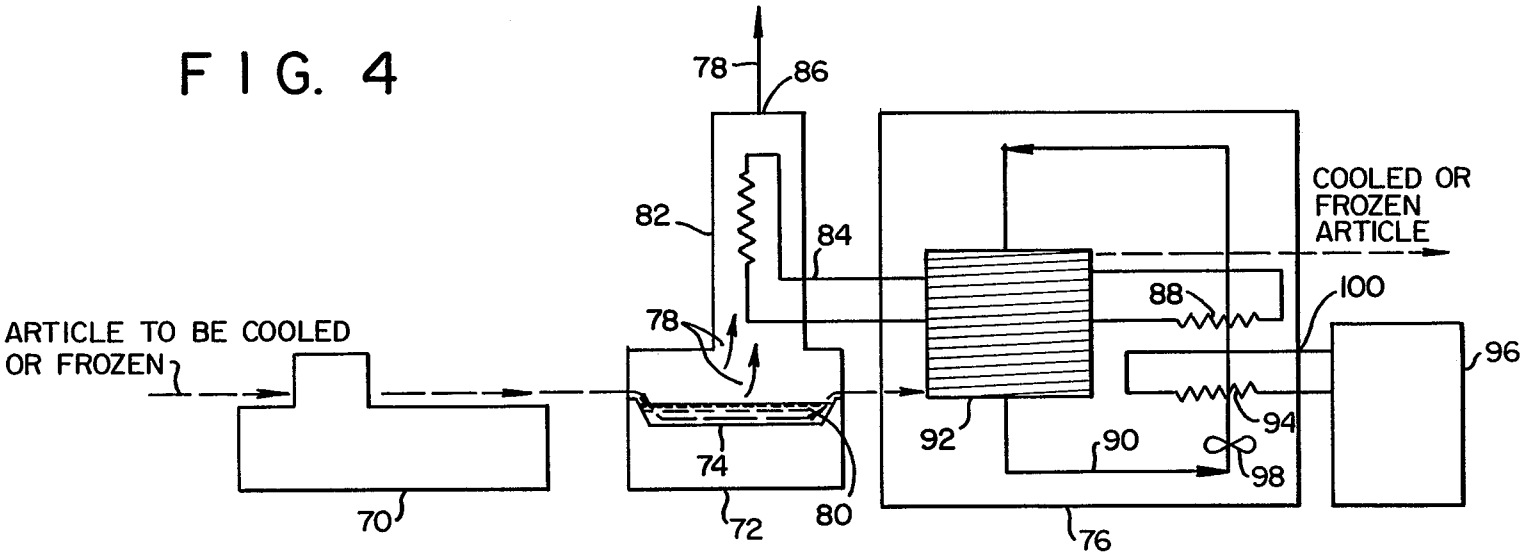
FIG. 4 is a schematic illustrating a second preferred embodiment cryo-mechanical combination freezer wherein cryogen vapors are used to remove heat content from a refrigerant fluid which is subsequently used to remove heat from recirculated cold gases in the mechanical refrigeration system (as a supplement to the heat content removed from the cold gases by the chiller refrigerant circulated in the mechanical refrigeration system).

Another preferred embodiment of the present invention is shown in FIG. 4. The article to be cooled or frozen is placed on a loader 70 which feeds the article to a liquid cryogen contacting area 72. From the liquid cryogen contacting area 72, comprising an immersion bath 74 in FIG. 4, the article passes to a mechanical refrigeration system 76. The cryogen vapor 78 generated on contact between the article and the liquid cryogen 80 in bath 74 is passed through conduit 82 where it is used to remove heat from a heat transfer fluid in heat transfer loop 84. The direction of cryogen vapor 78 flow relative to the direction of flow of heat transfer fluid in loop 84 can be cocurrent or countercurrent; however, countercurrent flow provides increased heat transfer efficiencies. Cryogen vapors 78 exit conduit 84 through exit duct 86.

Heat exchange loop 84, having heat exchange surface 88 within mechanical refrigeration system 76, is used to remove heat content from cold gases 90 which are circulated through mechanical refrigeration chamber 92. In chamber 92 the cold gases 90 are directly contacted with the articles to be reduced in temperature. Additional heat content removal from cold gas stream 90 is supplied by heat exchange surface 94 which contains a refrigerant which is cooled in chiller 96. A blower or fans 98 are used to direct the cold gas stream 90 past heat exchange surfaces 94 and 88.

It is possible to elevate heat transfer surface 82 above the location of heat transfer surface 88, so gravity can be used to recirculate the refrigerant in loop 84, eliminating the need for a pump on loop 84, depending on the overall design of this heat exchange loop.

The mechanical refrigeration chiller 96 can be suplemented in its heat removal capability by using cryogen vapors to subcool the chilled refrigerant in the manner described with reference to FIG. 3, depending on the acceptable temperature operating range for the refrigerant and chiller and the availability of cryogen vapor over a compatible temperature range.

In FIG. 4, as in FIG. 3, the position of elements relative to each other within the cryogenic portion of the system or within the mechanical refrigeration portion of the system is not intended to be limiting.

Figure 5:
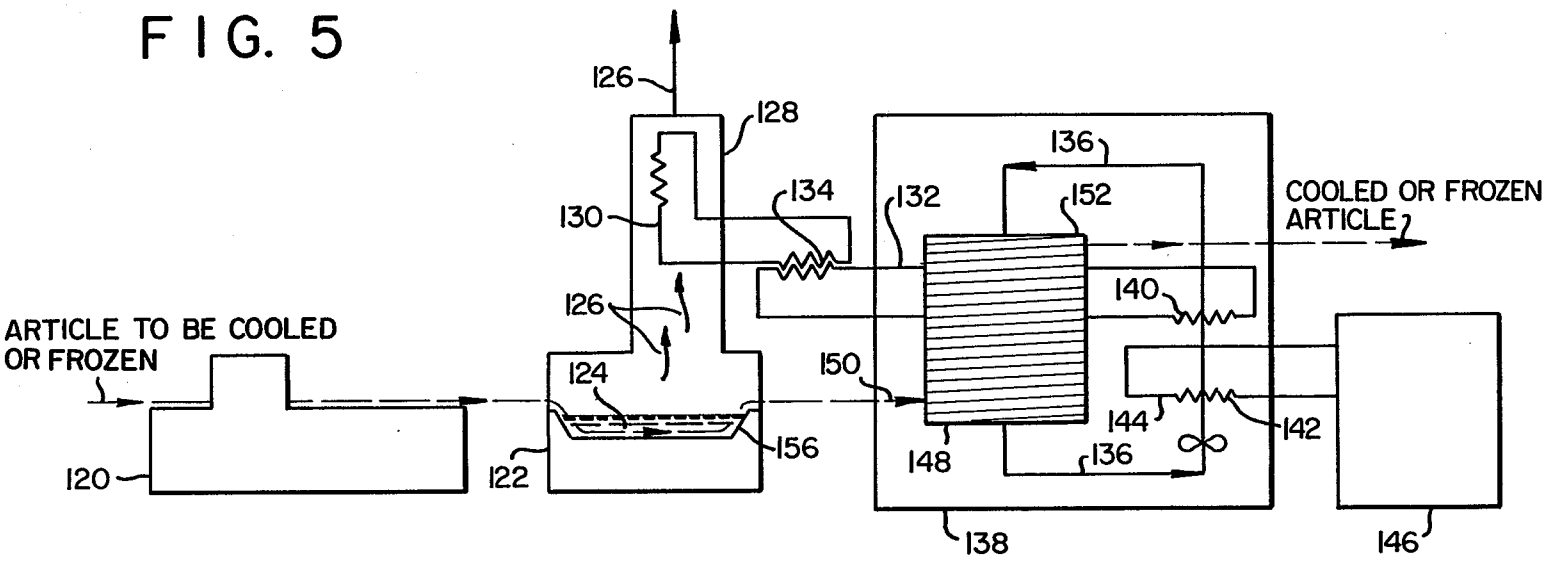
FIG. 5 is a schematic showing a third preferred embodiment cryo-mechanical combination freezer wherein cryogen vapors are used to remove heat content from a refrigerant fluid which is subsequently used to remove heat from an intermediary fluid which is used to reduce the heat content of cold gases circulated in the mechanical refrigeration means (as a supplement to the heat content removed from the cold gases by the chiller refrigerant circulated in the mechanical refrigeration system).
Figure 6:
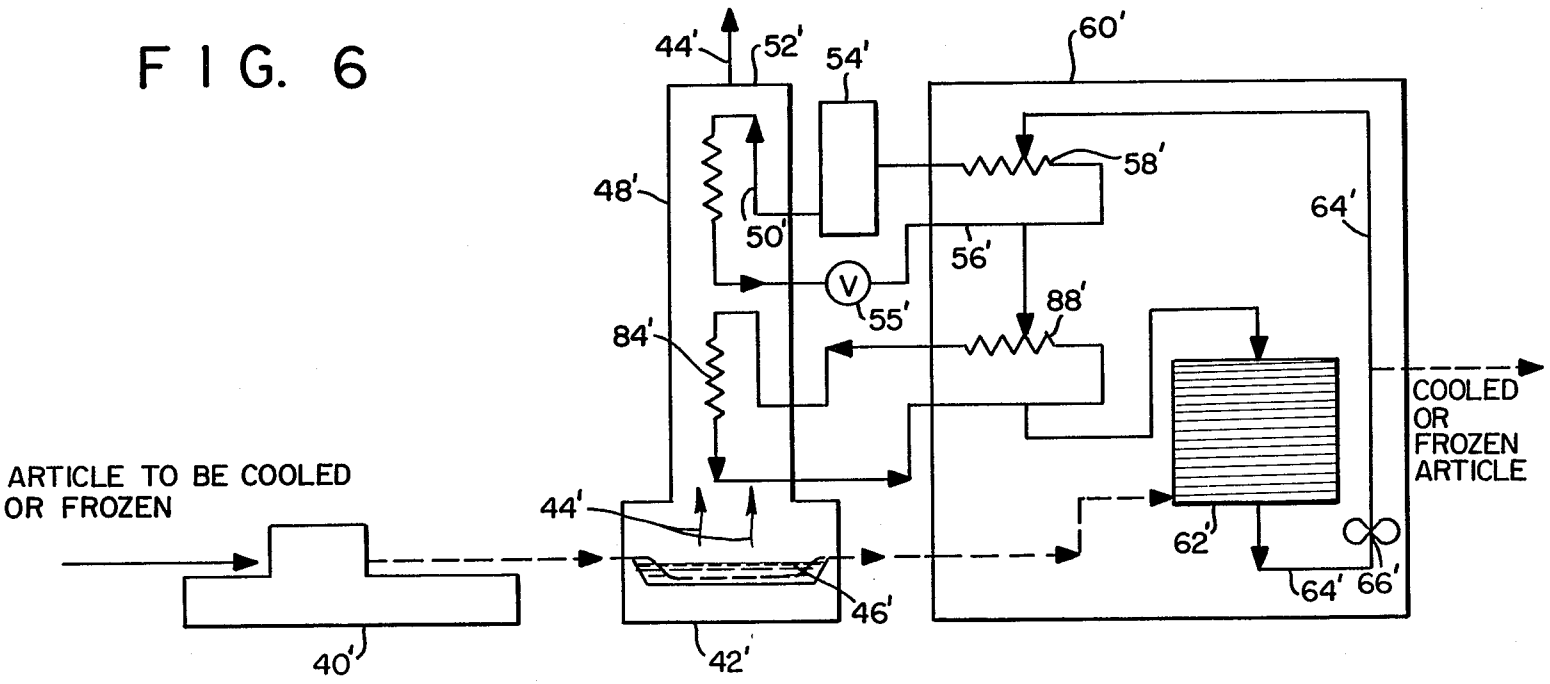
FIG. 6 is a schematic showing a fourth preferred embodiment cryo-mechanical combination freezer wherein cryogen vapors are used to remove heat content from a refrigerant fluid which is subsequently used to remove heat from a plurality of intermediary fluids which are used to reduce the heat content of cold gases circulated in the mechanical refrigeration means (as a supplement to the heat content removed from cold gases by the chiller refrigerant circulated in the mechanical refrigeration system).

FIG. 5 shows another, but less preferred, embodiment of the present invention. With reference to FIG. 5, the article to be cooled or frozen is transported from loading area 130 to the liquid cryogen contacting area 122 wherein the article is immersed in a bath of liquid cryogen 124. Cryogen vapors 126 generated on immersion of the article are passed through a conduit 128 where the vapors 126 contact heat exchange means 130 comprising an intermediary heat exchange fluid. Heat exchange means 130 is used to remove heat content from a second indirect heat exchange means 132 at heat exchange surface 134. Heat exchange means 132 removes heat content from cold gases 138 circulating in mechanical refrigeration system 138, at heat exchange surface 140. Heat content is also removed from cold gases 136 circulating in mechanical refrigeration system 138 at heat exchange surface 142 of heat exchange loop 144 which contains a refrigerant cooled by chiller 146. The article being cooled or frozen, after exiting immersion bath 124, enters a mechanical refrigeration contacting chamber 148 where it is contacted with cold gases 136 to remove heat and bring the article to the desired temperature. In the more preferred embodiments of the present invention, the mechanical refrigeration contacting chamber 148 is a spiral shaped heat exchange chamber. The article enters chamber 148 at the bottom 150 of the spiral on a conveyor and travels up the spiral towards exit 152 at the top of the chamber. Cold gases 136 flow countercurrently to the direction of article movement, down the spiral and out near exit 150. It is possible to alter the direction of cold gas flow to provide cocurrent flow or crossflow of cold gases relative to the article flow direction.

In an embodiment now shown in FIG. 5, cryogen vapor from immersion bath 124 can be flowed to the lower portion of chamber 148 to supplement cooling provided by cold gases 136, depending on the article being cooled. Introduction of cryogen vapors directly into the mechanical refrigeration system may be desirable if the crust frozen surface of the article would remelt absent the presence of cryogen vapor in the initial portions of chamber 148 where the article enters. Again, equipment operation limitations and safety considerations must be reviewed if cryogen vapor is to be flowed to the mechanical refrigeration system.

The design of a liquid cryogen immersion bath or liquid cryogen spray system for the liquid cryogen contact portion of the cryo-mechanical combination freezer should be such that it provides flexibility in throughput rate. In the case of an immersion bath, a design which permits variation in residence time of the article in the bath is necessary. Residence time can be increased by increasing liquid level in a bath having slanted sides 156 as shown in FIG. 5 and by decreasing conveyor speed through the bath. The longer the residence time of the article in the immersion bath, the lower the refrigeration load on the mechanical portion of the cryo-mechanical freezer, and the greater the quantity of articles which can be put through the freezer in a given time period. Use of the immersion bath to provide a greater share of the heat content removal than is necessary to form and maintain a frozen crust on the article during mechanical refrigeration is not as economical in terms of power consumption. However, this capability provides flexibility in handling of throughput rate which is of great value to processors of foodstuffs who have large seasonable demand figures. Use of the method and apparatus of the present invention to take advantage of the heat content removal capability in the cryogen vapors generated during the liquid cryogen contacting period enables foodstuff processors to handle processing demand swings in a manner which is economically feasible.

As disclosed above, the overall time required to freeze a given quantity of articles can be decreased by increasing the residence time of the articles in liquid cryogen. For example, when freezing hamburger patties about 0.375 inch thick and about 5.0 inches in diameter, the freezing time can be reduced from about 18 minutes for 100 percent mechanical freezing to as little as about 40 seconds for 100 percent liquid nitrogen immersion freezing.

It is important that the article surface remain in a frozen crust after leaving the immersion bath to prevent loss of fluids from within the article. Remelting of the surface would be more likely in cases such as cooked foodstuff articles in which the core of the article remains relatively hot after immersion, for example about 90° F. in the case of a hamburger patty. When articles with hot cores, such as hamburger patties are removed from a liquid nitrogen bath it is preferred to have at least a short cocurrent heat transfer section in which cryogen vapors contact the patties prior to the patties passing to the mechanical refrigeration means, The cryogen gas withdrawn from cocurrent heat transfer section can be sent on for use in heat content load reduction in the mechanical refrigeration means as previously discussed.

The above disclosure illustrates typical embodiments which demonstrate both the method and apparatus of the present invention. The best mode of the invention as presently contemplated is disclosed. However, one skilled in the art will recognize the broad range of applicability of the invention and numerous variations which without altering the concept of the invention can be used to accomplish the results obtainable by the invention. It is the intent of the inventors to include all equivalent embodiments which fall within the spirit and scope of the invention as expressed in the appended claims.

What is claimed:

1. A method of cooling and freezing an organic-comprised article, comprising the steps of contacting said article which is to be reduced in temperature with a liquid cryogen and subsequently contacting said article with cold gases in a mechanical refrigeration system to further cool said article, wherein the improvement comprises:

using at least a portion of the cryogen vapor generated by the direct contact of said article with said liquid cryogen for indirect heat exchange with a heat transfer fluid used within said mechanical refrigeration system.

2. The method of claim 1 wherein at least a portion of said cryogen vapor is used, via indirect heat transfer, to remove heat from a refrigerant fluid which is subsequently used to remove heat from said cold gases within said mechanical refrigeration system.

3. The method of claim 1 wherein at least a portion of said cryogen vapor is used, via indirect heat transfer, to remove heat from a refrigerant used in a chiller comprising said mechanical refrigeration system.

4. The method of claim 3 wherein said cryogen vapors used for indirect heat exchange with said chiller refrigerant flow in a direction which is substantially counter current to the general direction of flow of said refrigerant.

5. The method of claim 1 wherein at least a portion of said cryogen vapor is used, via indirect heat transfer, to remove heat from both a refrigerant fluid which is subsequently used to remove heat from said cold gases within said mechanical refrigeration system and from a refrigerant used in a chiller comprising said mechanical refrigeration system.

6. The method of claim 2 wherein said refrigerant fluid used to remove heat from said cold gases is used in addition to chiller refrigerant which is used independently to remove heat from said cold gases.

7. The method of claim 1 wherein at least a portion of said cryogen vapor is used, via indirect heat transfer, to remove heat from an intermediary refrigerant which is subsequently used, via indirect heat transfer, to remove heat from a refrigerant used in a chiller comprising said mechanical refrigeration system.

8. The method of claim 1 wherein at least a portion of cryogen vapor is used, via indirect heat transfer, to remove heat from an intermediary refrigerant which is subsequently used,via indirect heat transfer, to remove heat from both recirculating cold gases within said mechanical refrigeration system and from a refrigerant used in a chiller comprising said mechanical refrigeration system.

9. A method of cooling and freezing an organic-comprised article, comprising the steps of contacting said article which is to be reduced in temperature with a liquid cryogen and subsequently contacting said article with cold gases in a mechanical refrigeration system to further cool said article, wherein the improvement comprises using at least a portion of the cryogen vapor generated by the direct contact of said article with said liquid cryogen for indirect heat exchange with an intermediary refrigerant and subsequently using at least a portion of said cryogen vapor and said intermediary refrigerant to remove heat, via indirect heat transfer, from a heat transfer fluid used within said mechanical refrigeration system.

10. The method of claim 9 wherein said portion of cryogen vapor used for indirect heat transfer with said heat transfer fluid used within said mechanical refrigeration system has not been previously used for indirect heat exchange with said intermediary refrigerant.

11. The method of claim 1 wherein the portion of said cryogen vapor which has not been used for indirect heat exchange with said heat transfer fluid used within said mechanical refrigeration system is used in direct contact with said article within said mechanical refrigeration system.

12. The method of claim 1 wherein at least a portion of said cryogen vapor which has been used for indirect heat exchange with a heat transfer fluid used within said mechanical refrigeration system is used in direct contact with said article within said mechanical refrigeration system.

13. The method of claim 1 wherein at least a portion of said cryogen vapor generated upon contact of said liquid cryogen with said article is used in direct contact with said article to precool said article prior to contacting said article with said liquid cryogen.

14. The method of claim 1 wherein at least a portion of said cryogen vapor generated upon contact of said liquid cryogen with said article is used in direct contact with said article to postcool said article subsequent to contacting said article with said liquid cryogen but prior to entry of said article into said mechanical refrigeration system.

15. The method of claim 6, claim 7, or claim 7, wherein the portion of said cryogen vapor which has not been used for indirect exchange with said intermediary refrigerant is used in direct contact with said article within said mechanical refrigeration system.

16. The method of claim 6, claim 7, or claim 7 wherein said at least a portion of cryogen vapor which has been used for indirect heat exchange with said intermediary refrigerant is used in direct contact with said article within said mechanical refrigeration system.

17. The method of claim 1, claim 9, claim 10, or claim 12 wherein said liquid cryogen is applied to the surface of said article using a method selected from the group consisting of immersion of said article in liquid cryogen, spraying the surface of said article with liquid cryogen, or combinations thereof.

18. A combination cryogenic mechanical freezer, comprising a first means for contacting an article to be reduced in temperature with a liquid cryogen whereby the temperature of said article is reduced, and a second means for further cooling said article, said first means in communication with said second means, said second means comprising a mechanical refrigeration means for transferring heat from said article to cold gases and means for producing said cold gases, wherein said means for producing cold gases is in communication with said mechanical means for transferring heat from said article to said cold gases, wherein the improvement comprises:

using a cold gases production means which includes a mechanical refrigeration chiller, and wherein cryogen vapor produced in said liquid cryogen contacting means is used in contact with at least one indirect heat transfer means which is in contact with said cold gases, whereby said cold gases which are circulated within said mechanical refrigeration means are cooled.

19. The combination cryogenic-mechanical freezer of claim 18 wherein said indirect heat transfer means comprises a first heat transfer surface having cryogen vapor on one side and chiller refrigerant on the other side, whereby the heat content of said chiller refrigerant is reduced, and a second heat transfer surface, which is in communication with said chiller refrigerant from said first heat transfer surface, said second heat transfer surface having chiller refrigerant on one side and cold gases on the other side, whereby the heat content of said cold gases is reduced.

20. The combination cryogenic-mechanical freezer of claim 18 wherein said indirect heat transfer means comprises a first heat transfer surface having cryogen vapor on one side and a refrigerant fluid on the other side, whereby the heat content of said refrigeration fluid is reduced, wherein the refrigerant fluid from said first heat transfer surface is in communication with a second heat transfer surface having refrigerant fluid on one side and mechanical refrigeration system cold gases on the other side, and wherein said second heat transfer surface is used in addition to a third heat transfer surface having chiller refrigerant on one side and cold gases on the other side, whereby the heat content of the cold gases is additional reduced.

21. The combination cryogenic-mechanical freezer of claim 18 wherein said indirect heat transfer means comprises at least two heat transfer loops which are contacted with said cryogen vapor, and wherein said two heat transfer loops comprise a first heat transfer loop for removing heat from said chiller refrigerant and a second heat transfer loop for removing heat from a refrigerant which is subsequently used to remove heat from cold gases circulating in said mechanical refrigeration system.

22. The combination cryogenic-mechanical freezer of claim 18 wherein said indirect heat transfer means comprises a first heat transfer surface having cryogen vapor on one side of an intermediary refrigerant fluid on the other side, whereby the heat content of said intermediary fluid is reduced, wherein said intermediary refrigerant fluid from said first heat transfer surface is in communication with a second heat transfer surface having said intermediary refrigerant fluid on one side and chiller refrigerant on the other side, whereby the heat content of said chiller refrigerant is reduced, and wherein said chiller refrigerant from said second heat transfer surface is in communication with a third heat transfer surface having chiller refrigerant on one side and cold gases on the other side, whereby the heat content of said cold gases is reduced.

23. The combination cryogenic-mechanical freezer of claim 18 wherein said indirect heat transfer means comprises a first heat transfer surface having cryogen vapors on one side and a first refrigerant fluid on the other side, whereby the heat content of said first refrigerant is reduced, wherein said first refrigerant fluid from said first heat transfer surface is in communication with a second heat transfer surface having said first refrigerant fluid on one side and a second refrigerant fluid on the other side, where the temperature of said second refrigerant is reduced, and wherein said second refrigerant fluid from said second heat transfer surface is in communication with a third heat transfer surface having said second refrigerant on one side and cold gases on the other side, whereby the temperature of said cold gases is reduced, and wherein said third heat transfer surface is used in addition to a fourth heat transfer surface having chiller refrigerant on one side and cold gases on the other side, whereby the heat content of said cold gases is additionally reduced.

24. The combination freezer of claim 18 wherein said liquid cryogen contacting means is selected from the group consisting of liquid cryogen immersion means, liquid cryogen spray means, or combinations thereof.

25. The combination freezer of claim 18 wherein said liquid cryogen contacting means is an immersion means.

* * * * *

UNITED STATES PATENT AND TRADEMARK OFFICE

CERTIFICATE OF CORRECTION

PATENT NO. : 4,856,285

DATED : August 15, 1989

INVENTOR(S) : Arun Acharya et al

It is certified that error appears in the above-identified patent and that said Letters Patent is hereby corrected as shown below:

In The Specification

In column 5, line 43 delete "colds" and insert --cold-- therefor.

In The Claims

In claim 14, line 1 delete "claim 1" and insert --claim 5, claim 6, or claim 7,-- therefor.

In claim 15, line 1 delete "claim 6, claim 7, or claim 7" and insert --claim 5, claim 6, or claim 7-- therefor.

In claim 16, line 1 delete "claim 6, claim 7, or claim 7" and insert --claim 1, claim 8, claim 10, or claim 12-- therefor.

In claim 17, lines 1 and 2 delete "claim 1, claim 9, claim 10, or claim 12" and insert --claim 3-- therefor.

Signed and Sealed this

Seventeenth Day of July, 1990

*Attest:*

*Attesting Officer*

HARRY F. MANBECK, JR.

*Commissioner of Patents and Trademarks*